US005440905A

United States Patent [19]

Yamada

[11] Patent Number: 5,440,905

[45] Date of Patent: Aug. 15, 1995

[54] DOOR LOCKING HANDLE ASSEMBLY OF A PULL-OUT AND SIDE-SWINGING LEVER-ACTION TYPE

[75] Inventor: Kenichi Yamada, Tokyo, Japan

[73] Assignee: Takigen Manufacturing Co. Ltd., Tokyo, Japan

[21] Appl. No.: 191,806

[22] Filed: Feb. 3, 1994

[30] Foreign Application Priority Data

Feb. 12, 1993 [JP] Japan ..... 5-009569 U

[51] Int. Cl.[6] ..... E05B 13/00

[52] U.S. Cl. ..... 70/208; 70/210; 70/224; 292/202; 292/244; 292/DIG. 31

[58] Field of Search ..... 70/208, 210, 215, 224, 70/467, 469, 489, 192–197, 201, 205, 462, 466, DIG. 31, DIG. 33; 292/202, DIG. 31, DIG. 72, 244, 336.3

[56] References Cited

U.S. PATENT DOCUMENTS 2,218,960 10/1940 Rightmyer ..... 292/DIG. 31 X
2,377,301 5/1945 Rolph ..... 70/208
4,838,056 6/1989 Weinerman et al. ... 292/DIG. 31 X

FOREIGN PATENT DOCUMENTS 198764 12/1988 Japan .
66369 6/1991 Japan .

*Primary Examiner*—Lloyd A. Gall
*Attorney, Agent, or Firm*—Martin Smolowitz

[57] ABSTRACT

Door locking handle assembly of a pull-out and side-swinging lever-action type, which comprises a casing (2) containing a rotatable locking shaft (5) having a catch plate (4) which is easily mounted on either side of a door, and a handle (8) folded into the casing can be projected outward and operated smoothly regardless of the thickness of the catch plate. A longitudinal groove (60) is provided in an outer surface of the locking shaft (5) (which is connected with the handle (8) through a cross pivot (7)) to open to its rear-end side, and has its front-end portion crossed with a circumferential groove (61) in the outer surface of the shaft (5); and provided in an inner surface of a cylindrical portion (3) (in which the shaft (5) is received) of the casing (2) is a drop-prevention projection (62) which passes through the longitudinal groove (60) to engage with the circumferential groove (61), the projection (62) being so arranged as to be misaligned with the longitudinal groove (60) when the shaft (5) rotates to travel between its locking and its unlocking position.

2 Claims, 8 Drawing Sheets

DOOR LOCKING HANDLE ASSEMBLY OF A PULL-OUT AND SIDE-SWINGING LEVER-ACTION TYPE

BACKGROUND OF THE INVENTION

1. Field of the Invention

The present invention relates to a door locking handle assembly of a pull-out and side-swinging lever-action type. The door locking handle assembly is used in a plugboard box and the like. In operation, the retractable handle of the assembly is pulled out of its casing and side-swung through a predetermined angle to permit a catch plate of the assembly to be free from a receiving portion of a stationary frame element.

2. Description of the Prior Art

In a conventional door locking handle assembly of a pull-out and side swinging lever-action type disclosed in Japanese Utility Model Laid-Open No. Sho 63-198764: a cylinder portion is provided in a base-end portion of a casing fixedly mounted on a door; a locking shaft is totalably mounted in the cylindrical portion in an insertion manner; a catch plate is fixedly mounted on a rear-end portion of the locking shaft; a retractable handle folds into a front concave portion of the casing, and has its base-end portion pivoted to a front-end portion of the locking shaft through a cross pivot; a biasing spring for swingably biasing the retractable handle in its projecting direction on the cross pivot, the biasing spring being mounted between the locking shaft and the handle; a locking aperture is provided in a finger-engaging projecting portion of a front-end portion's rear surface of the handle; a lock unit is fixedly embedded in a lock-receiving portion provided in a front-end portion of the casing; and, a latch element is so arranged as to be interlocked with a rotor of the lock unit, and is biased forward towards the finger-engaging projecting portion by a return spring to have a front-end portion of the latch element engaged with the locking aperture so that the handle is locked up in its retracted position.

However, in the conventional door locking handle assembly described above, there is a fear that the front-end portion of the handle hits a user's fingers. Namely, when the user inserts a key into the lock unit to have its rotor rotated in an unlocking direction thereof, the latch element slidably moves backward to be free from the locking aperture of the handle, so that the handle is projected forward and turned under the influence of a resilience force exerted by a biasing spring, whereby the front-end portion of the handle hits the user's fingers.

In order to prevent the handle from hitting the user's fingers, it is sufficient to dispose the lock unit in a position far away from the front-end portion of the handle. However, naturally, this causes the entire length of the casing to increase.

In order to set a sufficient interval between the lock unit and the handle without increasing the entire length of the casing, it is sufficient to decrease the handle in length. However, when a grip portion of the handle is extremely shortened, the handle is impaired in operability. Consequently, such shortening of the grip portion of the handle is not adequate.

When the catch plate is converted from a left-hand turning/stopping type to a right-hand turning/stopping type, or vice versa, i.e., when a mounting position of the locking handle assembly is moved from the door's left side to the door's right side, or vice versa, it is necessary to change the catch plate in its orientation. However, in this conventional locking handle assembly, when the catch plate is dismounted from the locking shaft, the locking shaft moves forward along the cylindrical portion to permit both the handle and the locking shaft to drop out of the casing. Consequently, the user must hold the locking shaft to prevent the same from moving forward when he changes the orientation of the catch plate in mounting operation of the assembly, which is very cumbersome.

Further, when the catch plate is smaller in thickness than a predetermined value, the locking shaft may move forward by a distance corresponding to a difference between the thickness of the catch plate and the predetermined value. This causes the base-end edge portion of the handle to engage with an edge portion of the front concave portion of the casing, which makes the base-end edge portion of the handle unworkable by jamming.

SUMMARY OF THE INVENTION

It is an object of the present invention to provide a door locking flush halide assembly of a pull-out and side-swinging lever-action type, in which assembly a grip portion of a handle has a sufficient effective length while the entire length of a casing adapted for receiving the handle is minimized.

It is another object of the present invention to provide a door locking handle assembly of a pull-out and side-swinging lever-action type, in which assembly: a locking shaft is prevented from moving forward; a catch plate is easily mounted on either side of a door; and a swinging operation of a handle is smoothly performed without being influenced by the thickness of the catch plate.

The above objects of the present invention are accomplished by providing:

- a door locking handle assembly of a pull-out and side-swinging lever-action type, comprising:
- a casing for fixedly mounting on a door;
- a locking shaft rotatably mounted in a cylindrical portion of a base-end portion of the casing in an insertion manner, the locking shaft having its rear-end portion fixed to a catch plate;
- a retractable handle which folds into a front concave portion of the casing, and has its base-end portion pivoted to a front-end portion of the locking shaft through a first cross pivot;
- a biasing spring for swingably biasing the retractable handle in its projecting direction on the first, cross pivot, the biasing spring being mounted between the locking shaft and the handle;
- a push button which is connected with a front-end portion of the handle through a second cross pivot and is provided with a projecting leg portion in its rear side, the leg portion having its front-end portion formed into a locking aperture and an engaging-hook portion;
- a position-keeping spring disposed between the handle and the push button to align the push button with the handle along an extension line of the handle;
- a lock unit which is fixedly embedded in a lock-receiving portion of a front-end portion of the casing, and comprises a rotor which is rotated by a key to move a latch element forward and backward so that the latch element engages with and disengages from the locking aperture respectively, the latch element being biased forward by a return spring toward the leg portion;

a leaf spring disposed in a position behind a rear surface of the latch element and fixedly mounted in the position, the leaf spring having its front-end bent portion engaged with the engaging-hook portion of the leg portion when the push button is depressed to swing on the second cross pivot, so that the push button is held in the thus depressed position;

the latch element having a length permitting a front-end portion of the latch element to be free from the engaging-hook portion of the push button in the depressed position when the latch element is held in its backwardly retracted position;

the locking shaft being provided with a longitudinal groove in its outer surface to permit the longitudinal groove to open to its rear surface side, the longitudinal groove having its front-end portion crossed with a circumferential groove in the outer surface of the locking shaft;

the cylindrical portion of the casing being provided with a drop-prevention projection in its inner surface, the projection passing through the longitudinal groove to engage with the circumferential groove; and the drop-prevention projection being so arranged as to be misaligned with the longitudinal groove when the locking shaft rotates to travel between its locking and its unlocking position.

BRIEF DESCRIPTION OF THE DRAWINGS

FIG. 10 is a right-side view of the locking shaft of the door locking handle assembly; and .

DESCRIPTION OF THE PREFERRED EMBODIMENTS

Figure 1:
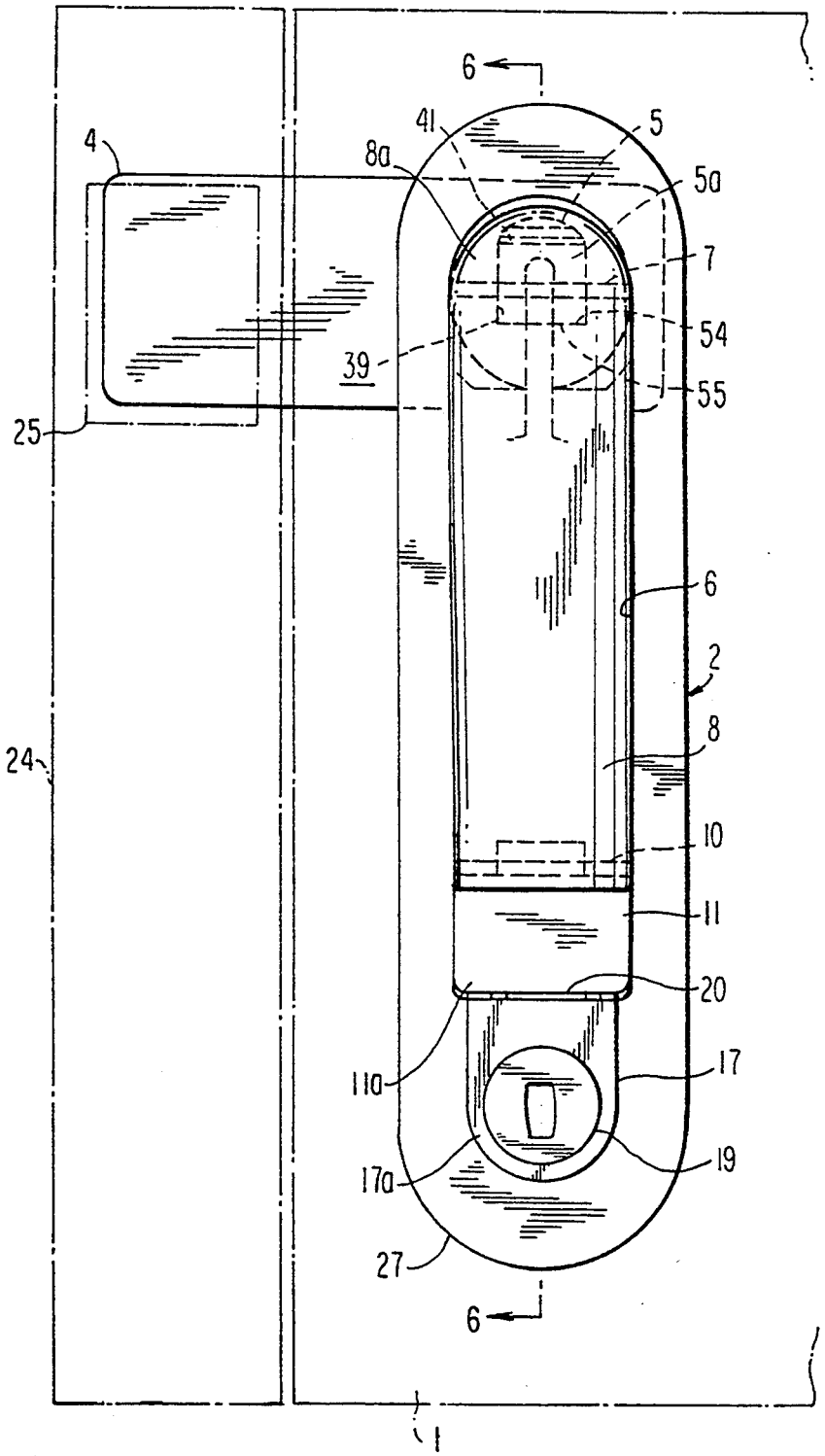
FIG. 1 is a front view of an embodiment of the door locking handle assembly of a pull-out and side-swinging lever-action type of the present invention.
Figure 2:
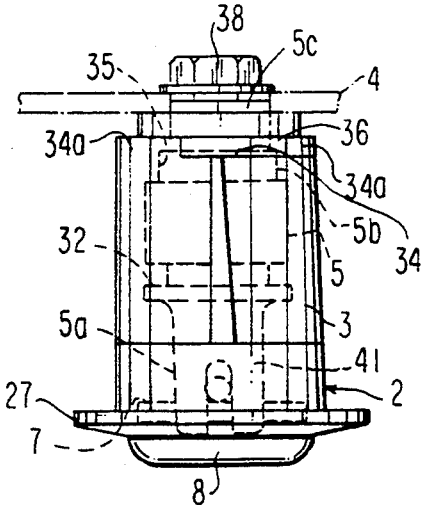
FIG. 2 is a plan view of the door locking assembly of the present invention shown in FIG. 1.
Figure 3:
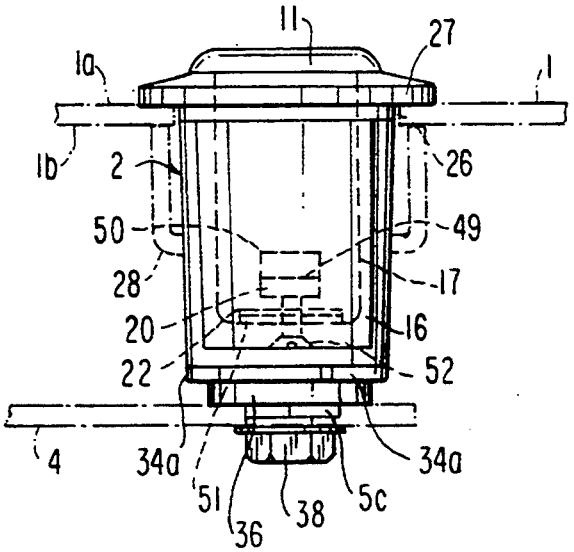
FIG. 3 is a bottom view of the door locking assembly of the present invention shown in FIG. 1.
Figure 5:
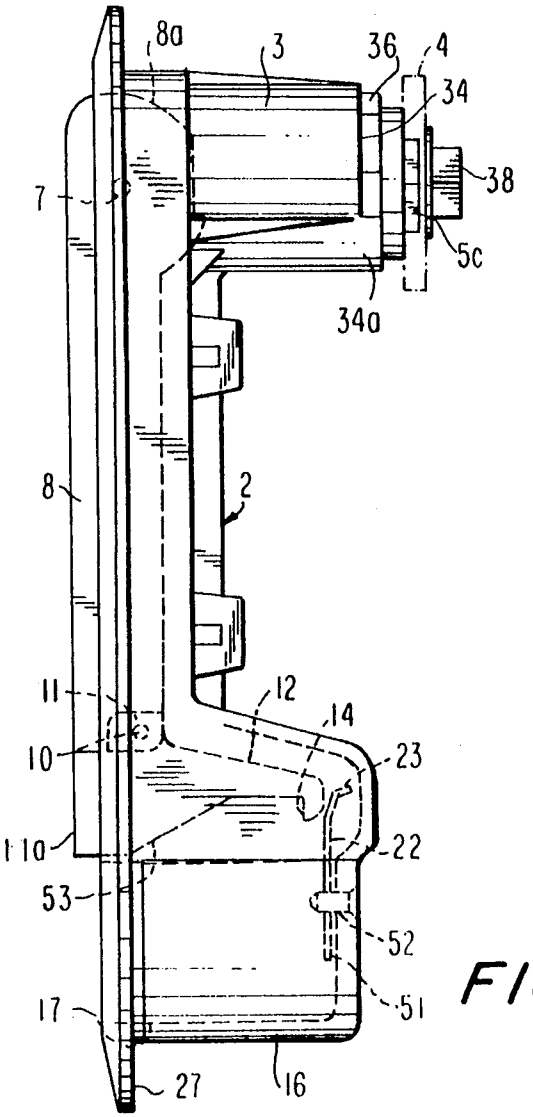
FIG. 5 is a right-side view of the door locking assembly of the present invention shown in FIG. 1.
Figure 4:
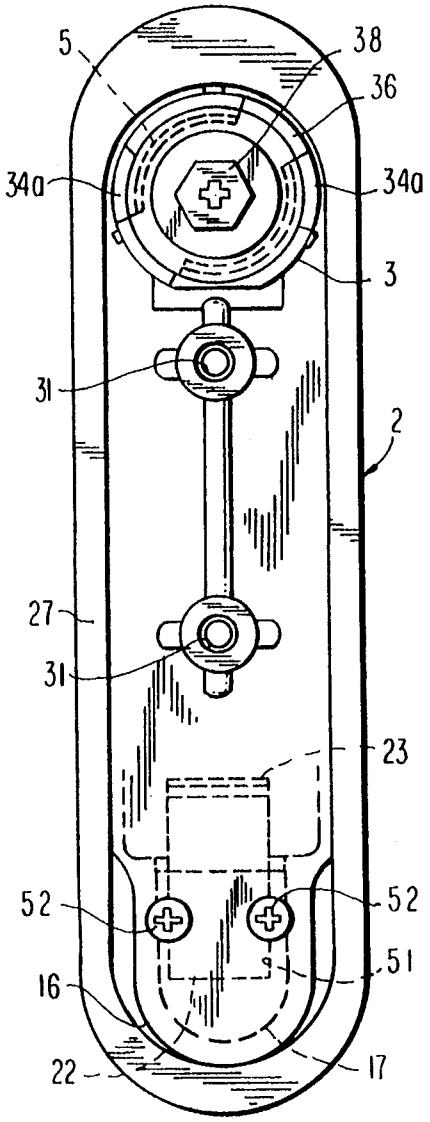
FIG. 4 is a rear view of the door locking assembly of the present invention shown in FIG. 1.

Hereinbelow, the present invention will be described in detail with reference to the accompanying drawings and the reference numerals and characters.

In a door locking handle assembly of a pull-out and side-swinging lever-action type according to the present invention, as shown in FIG. 1, a casing 2 is fixedly mounted on a door 1, and provided with a cylindrical portion 3 in its base-end portion. Rotatably mounted in the cylindrical portion 3 is a locking shaft 5, to a rear-end portion of which a catch plate 4 is fixedly mounted. A retractable handle 8 folds into a front concave portion 6 of the casing 2 so as to be projectable therefrom. The handle 8 has its base-end portion pivoted to a front-end portion of the locking shaft 5 through a first cross pivot 7. A biasing spring 9 is disposed between the locking shaft 5 and the handle 8, and forces :the handle 8 to swing on the first cross pivot 7 in a projecting direction for the handle 8.

A push button 11 is connected with a front-end portion of the handle 8 through a cross pivot 10. Projected from a rear surface of the push button 11 is a leg portion 12 which is provided with a locking hole 13 and an engaging-hook portion 14 in its front-end portion. By means of a position-keeping spring 15 disposed between the handle 8 and the push button 11, the push button 11 is aligned with the handle 8 along an extension line of the handle 8. Provided in a front-end portion of the casing 2 is a lock-receiving portion 16 in which a lock unit 17 is fixedly embedded. The lock unit 17 comprises a rotor 10 which is rotated by a key 18 to move a latch element 20 forward and backward, so that the latch element 20 engages with and disengages from the locking hole 13, respectively. The latch element 20 is biased forward by a return spring 21 toward the leg portion 12.

A leaf spring 22 is disposed in a position behind a rear surface of the latch element 20, and fixedly mounted in the position. The leaf spring 22 has its front-end bent portion 23 engaged with the engaging-hook port i on 14 of the 1 leg portion 12 when the push button 11 is depressed to swing on the cross pivot 10, so that the push button 11 is held in the thus depressed position. The latch element 20 has a length permitting a front-end portion of the latch element 20 to be free from the engaging-hook portion 14 of the push button 11 in the depressed position, when the latch element 20 is held in its backwardly retracted position.

The locking shaft 5 is provided with a longitudinal groove 60 in its outer surface to permit the groove 60 to be open to its rear surface side. The longitudinal groove 60 has its front-end portion crossed with a circumferential groove 61 in the outer surface of the locking shaft 5. The cylindrical portion 3 of the casing 2 is provided with a drop-prevention projection 62 in its inner surface. The projection 62 passes through the longitudinal groove 60 to engage with the circumferential groove 61. The drop-prevention projection 62 is so arranged as to be misaligned with the longitudinal groove 60 when the locking shaft 5 rotates to travel between its locking and its unlocking position.

Figure 11:
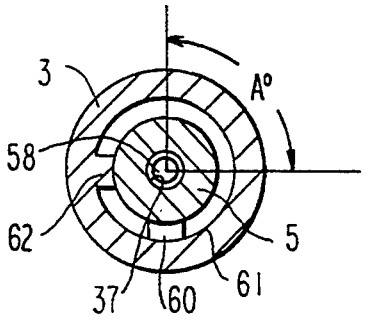
FIG. 11, is a cross-sectional view of the cylindrical portion of the casing, taken along the line 11—11 of FIG. 8.

In assembling, the locking shall 5 is inserted into the cylindrical portion 3 of the casing 2 in a condition in which the longitudinal groove 60 of the locking shaft 5 is aligned in position with the drop-prevention projection 62 of the cylindrical portion 3. When the drop-prevention projection 62 reaches the front-end portion of the longitudinal groove 60, the locking shaft is rotated through a predetermined angle to have the drop-prevention projection 62 inserted into the circumferential groove 61. As a result, as shown in FIG. 11, the drop-prevention projection 62 is out of a predetermined angle A° ranging from a locking position of the locking shaft 5 to an unlocking position thereof.

Figure 6:
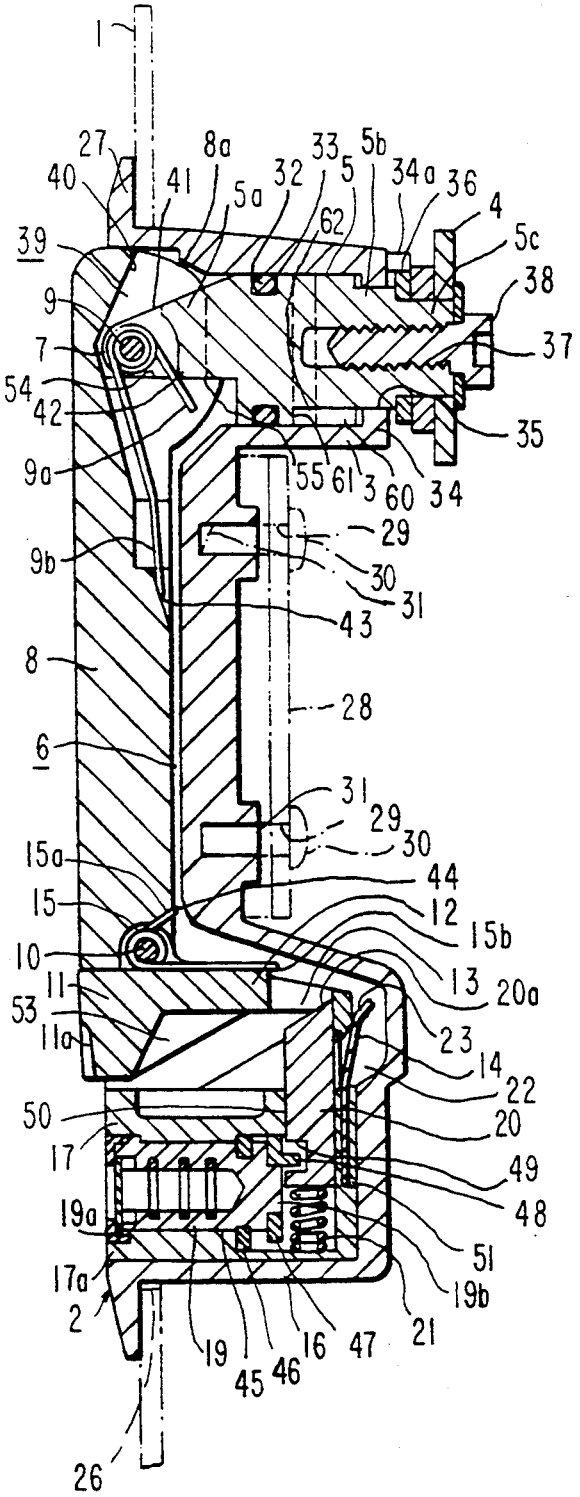
FIG. 6 is a sectional view of the door locking assembly of the present invention shown in FIG. 1, taken along the line 6—6.

As shown in FIG. 6, when the rotor 19 of the lock unit 17 is in the locking position, the latch element 20 is in its most advanced position to have its front-end portion engaged with the locking hole 13 of the leg portion 12 of the push button 11. Consequently, in this condition: the handle 8 is held in its retracted position within the front concave portion 6 of the casing 2; the catch plate 4 fixed to the locking shaft 5 is held in a position in which the catch plate 4 engages with a receiving portion 25 of a stationary frame element 24; and, the door 1 is locked to the stationary frame element 24.

Figure 7:
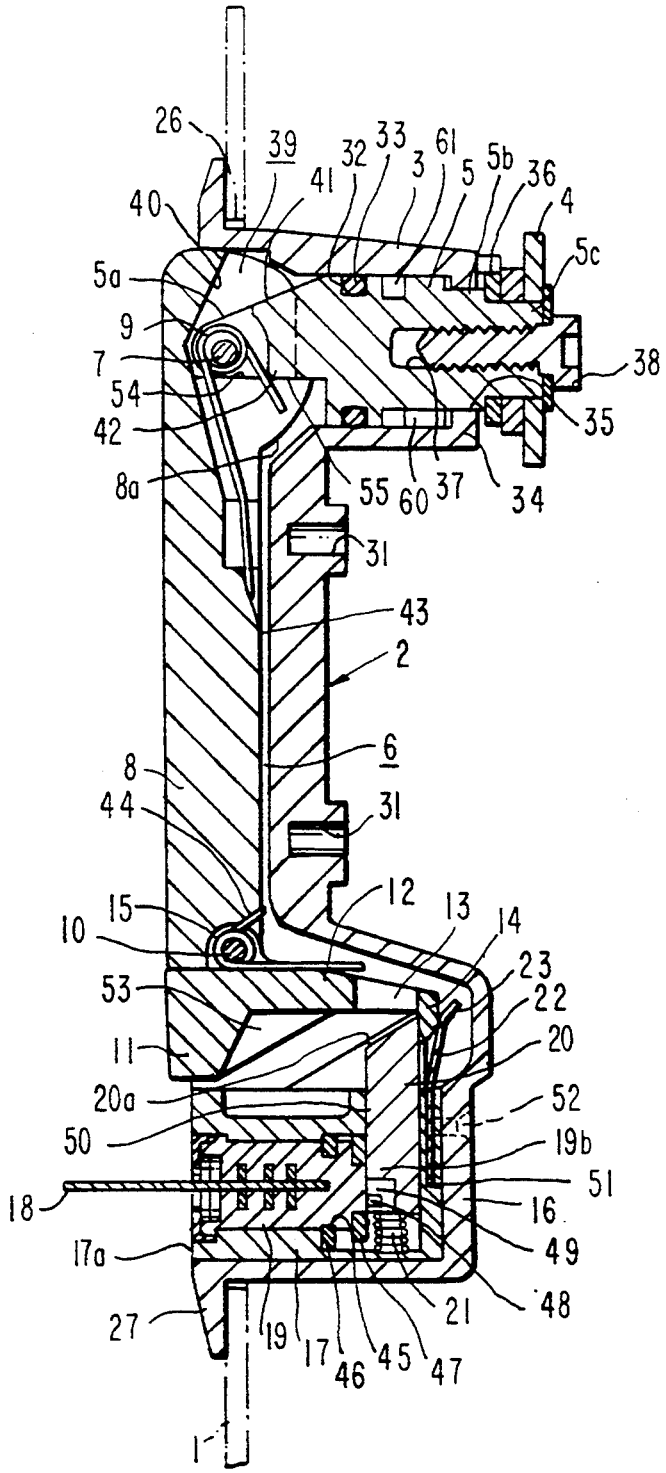
FIG. 7 is a sectional view similar to FIG. 6, in which the latch element is slidably retracted.

As shown in FIG. 7, when the key 18 is inserted into the lock unit 17 and rotates the rotor 19 in its unlocking direction, the latch element 20 interlocked with the rotor 19 is slidably moved rearward against a resilient force exerted by the return spring 21 so that a front-end portion of the latch element 20 is disengaged from the locking hole 13. At this Lime, the front-end portion of the latch element 20 is still engaged with the engaging-hook portion 14 of the front-end portion of the push button 11, so that the handle 8 is also still held substantially in its retracted position within the front concave portion 6 of the casing 2.

Figure 8:
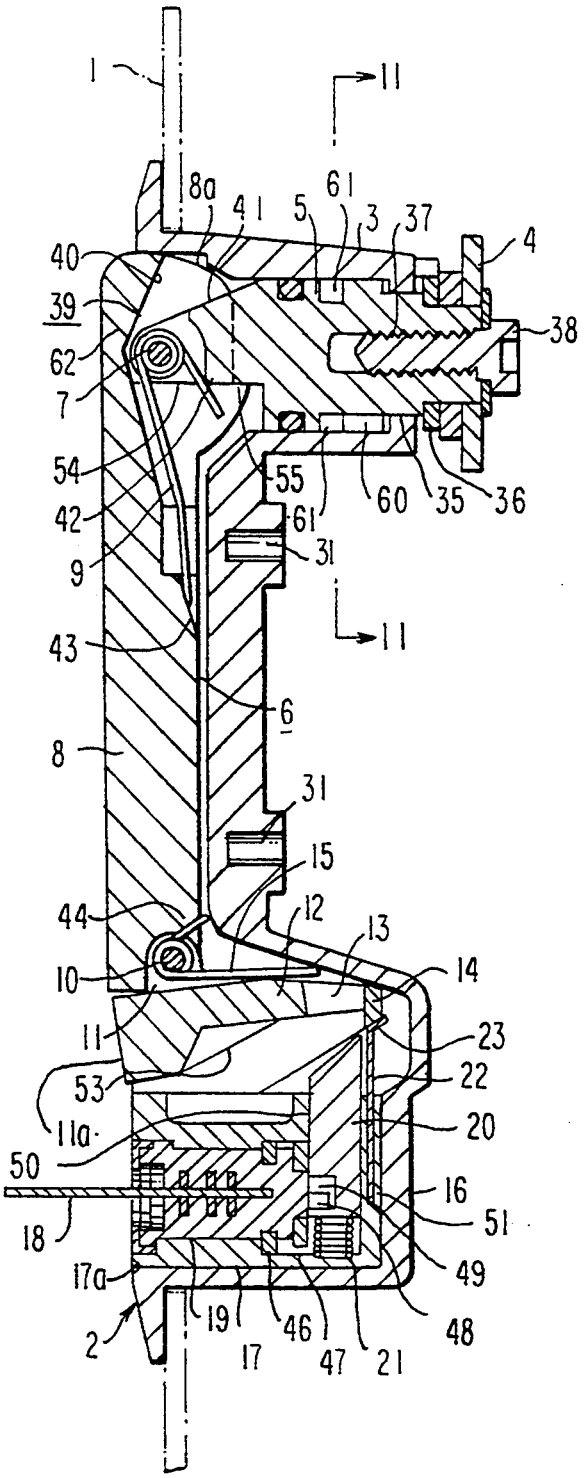
FIG. 8 is a sectional view similar to FIG. 6, in which the push button is depressed.

As shown in FIG. 8, when the push button 11 is depressed on its front portion 11*a* by the user's finger so that the button 11 is forcibly swung on the cross pivot 10 against a resilient force exerted by the position-keeping spring 15, the leg portion 12 of the push button 11 moves away from the lock unit 17 to have its engaging-hook portion 14 disengaged from the front-end portion of the latch element 20, whereby the handle 8 is disengaged from the lock unit 17.

At this time, the engaging-hook portion 14 of the push button 11 is still engaged with the bent portion 23 of the front-end portion of the leaf spring 22. Since the leaf spring 22 is greater in resilient force than the position-keeping spring 15, the push button 11 is held in its depressed position so that the engaging-hook portion 14 of the push button 11 is held in its retracted position in which the engaging-hook portion 14 is free from the front-end portion of the latch element 20.

Figure 9:
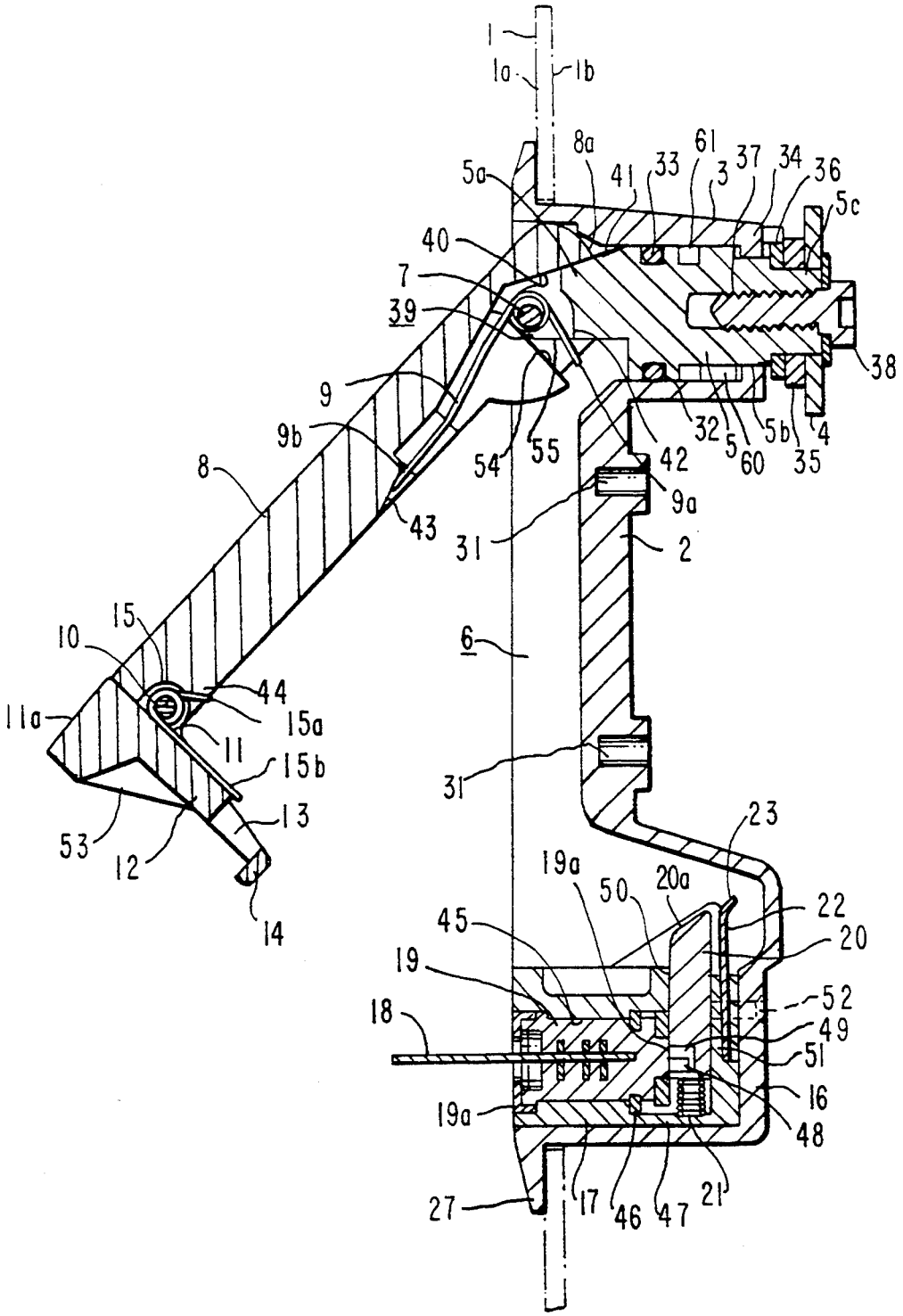
FIG. 9 is a sectional view similar to FIG. 6, in which the handle is swingably projected.
Figure 10:
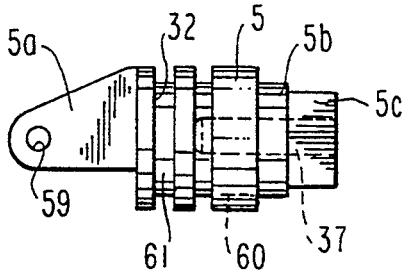

When the user's finger moves from the front portion 11*a* of the push button 11 to a front portion 17*a* of the lock unit 17 to have the push button 11 be free from the depressing force exerted by the user's finger, the handle 8 is immediately swung up on the first cross pivot 7 since the biasing spring 9 is greater in resilient force than the leaf spring 22. As a result, as shown in FIG. 9, the handle 8 is resiliently projected outwardly from the front concave portion 6 of the casing 2. When the handle 8 is projected, the push button 11 is rotated to its initial position under the influence of the resilient force exerted by the position-keeping spring 15, so that the push button is aligned with the handle 8 along the upper extension line of the handle 8.

When the thus projected handle 8 is side-swung in a predetermined direction, the locking shaft 5 (which is connected with the handle 8 through the first cross pivot 7 and rotatably supported by the cylindrical portion 3 of the casing 2) is rotated together with the handle 8, so that the catch plate 4 is disengaged from the receiving portion 25 of the stationary frame element 24. As a result, it is possible to open the door 1 (which is unlocked from the stationary frame element 24) by pulling the handle 8 forward. In such door opening operation, the leg portion 12 of the push button 11 (which is connected with the front-end portion of the handle 8) serves as an appropriate finger-engaging portion.

After the rotor 19 is rotated in the locking direction, the key 18 is pulled out of the lock unit 17 so that the latch element 20 is slidably returned to its most advanced position. After the door 1 is closed and the handle 8 is reversely swung to have the catch plate 4 engaged again with the receiving portion 25 of the stationary frame element 24, when the handle 8 is pushed into the front concave portion 6 of the casing 2, the engaging-hook portion 14 of the push button 11 pushes a front-end oblique surface 20*a* of the latch element 20. As a result, the latch element 20 is slidably moved rearward temporarily against the resilient force exerted by the return spring 21.

When the handle 8 is further pushed into the front concave portion 6 of the casing 2 so that the engaging-hook portion 14 of the push button 11 passes over the front-end portion of the latch element 20 to reach a rear surface of the element 20, the latch element 20 is immediately slidably moved forward under the influence of the resilient force exerted by the return spring 21 so that the front-end portion of the latch element 20 engages with the engaging-hook portion 14 of the push button 11, whereby the handle 8 is locked again to its retracted position in the casing 2.

As described above, when the user grips the handle 8 and side-swings the same in the locking or unlocking direction through the predetermined angle to have the catch plate 4 rotated between its locking arid its unlocking position, there is no fear that the drop-prevention projection 62 is aligned with the longitudinal groove 60.

In the embodiment of the present invention shown in the drawings, the casing 2 is fixedly mounted in the door 1 as follows. Namely, first, the casing 2 is inserted into a longitudinal opening portion 25 of the door 1 from its -front side, and has its outer peripheral flange portion 27 abutted against a front surface 1*a* of the door 1. Then, a U-shaped sheet metal 28, which is disposed between the cylindrical portion 3 and the lock-receiving. portion 15 of the casing 2, is abutted against a rear surface 1*b* of the door 1, and fixedly mounted on the door 1 through tapping screws 30 each of which passes through a through-hole 29 of the sheet metal 28 and is threadably connected with a blind hole 31.

A watertight O-ring 33 is fitted in an annular groove 32 of the intermediate portion of the locking shaft 5, which has its small-diameter portion 5*b* fitted in a shaft hole 35 of a rear-surface wall portion 34 of the cylindrical portion 3 of the casing 2. The small-diameter portion 5*b* of the locking shaft 5 is followed by a square-column portion 5*c* on which both a swing-angle limiting plate 36 and the catch plate 4 are mounted in an insertion manner, and then a bolt 38 is threadably connected with a. threaded hole 37 of the square-column portion 5*c* to have-these plates 36, 4 fixed to the square-column portion 5*c*, so that the locking shaft 5 is rotatably mounted in the cylindrical portion 3 of the casing 2 but not axially slidable therein. The rear-surface wall portion 34 of the cylindrical portion 3 of the casing 2 is provided with a swing-angle limiting projection 34*a* cooperating with the swing-angle limiting plate The base-end portion 8*a* of the handle 8 formed into a semicircular shape as viewed in FIGS. 5 to 9. A part corresponding to this base-end portion 8*a*, i.e., a root-portion's inner surface 3*a* of the cylindrical portion 3 of the casing 2, is formed into a semispherical shape, so that the handle 8 can side-swing or rotate together with the locking shaft 5 while being supported by the cylindrical portion 3 of the casing 2. The base-end portion 8*a* of the handle 8 is provided with a recess 39 in which a square-shaped planar front-end portion 5*a* of the locking shaft 5 fits. In operation, the handle 8 swings on the first cross pivot 7 relative to the locking shaft 5 while being guided by both the recess 39 and the square-shaped planar front-end portion 5*a* of the locking shaft 5. The recess 39 has its oblique inner surface 40 abut against an oblique outer surface of the locking shaft 5 to determine a projecting angle of the handle 8 relative to the casing 2. Further, the recess 39 has its horizontal inner surface 94 abut against a horizontal outer surface 55 of the locking shaft 5 to determine the retracted position of the handle 8. The biasing spring 9 is constructed of a coil type spring 9. The spring 9 has its coiled portion mounted on the first cross pivot 7 in an insertion manner, and its linear portion 9*a* abut against a notched edge portion 42 of the locking shaft 9. In addition, the biasing spring 9 has its remaining linear portion 9*b* abut against a notched edge portion 43 of a rear surface of the handle 8. On the other hand, the first cross pivot 7 is inserted in a through-hole 99 of the front-end portion of the locking shaft 9.

The position-keeping spring 15 is constructed of a coil type spring. The spring 19 has its coiled portion mounted on the cross pivot 10 in an insertion manner, and has its linear portion 15*a* abut against a notched edge portion 44 of a rear surface of the handle 8. In addition, the spring 19 has its remaining linear portion 15*b* abut against a side surface of the leg portion 12 of the push button 11. In the embodiment of the present invention, a disk-tumbler locking mechanism is used as a lock mechanism for locking the rotor 19 of the lock unit 17 to the main body of the unit. However, it is also possible to use any other suitable lock mechanisms such as radial-pin tumbler locking mechanisms, axial-pin tumbler mechanisms and the like.

In the lock unit 17, the rotor 19 is prevented from dropping out of the main body of the lock unit 17 by means of a drop-prevention ring 46 and a front-end flange portion 19*a* thereof, the ring 46 being fitted in an annular groove of a rear-end portion of the rotor 19. An interlocking cam plate 47 is fixedly mounted on a rear-end square-column portion 19*b* of the rotor 19 in an insertion manner so as to be not rotatable relative to the rotor 19. The cam plate 47 is prevented from dropping off of the rotor 19 by means of the latch element 20. A drive projection 48 of the interlocking cam plate 47 is inserted in a follower groove 49 of a front surface of the latch element 20. Consequently, the latch element 20 is slidably moved forward and rearward in a guide hole 50 as the rotor 19 is totaled clockwise or counterclockwise.

The return spring 21 is constructed of a compression coil spring, and disposed between an inner wall surface of the lock-receiving portion 16 and a base-end surface of the latch element 20 in an insertion manner. On the other hand, the leaf spring 22 has its base-end portion inserted in a receiving groove 51 of a rear-surface wall portion of the lock unit 17, and is fixedly mounted on the lock unit 17 through set screws 52. The leaf spring 22 is greater in force than the position-keeping spring 15, while the biasing spring 9 is greater in force than the leaf spring 22.

In this embodiment, the drop-prevention projection 62 is integrally formed with an inner surface of the cylindrical portion 3 of the casing 2. However, it is also possible to form the projection 62 independently of the cylindrical portion 3. Namely, the projection 62 lay be inserted into a receiving hole of the cylindrical portion 3 and fixed thereto. Further, it is also possible to have the leaf spring 22 fixed to the casing 2. The leg portion 12 of the push button 11 is provided with a reinforcing rib 53.

As described above, in the present invention, the push button 11 is connected with the front-end portion of the handle 8. Both the locking hole 13 and the engaging-hook portion 14 are provided in the front-end portion of the leg portion 12 of the push button 11, the leg portion 12 projecting from the rear surface of the push button 11. The push button 11 is aligned with the handle 8 by the position-keeping spring 15 along the upper extension line of the handle 8. The leaf spring is fixedly mounted behind the rear surface of the latch element 20, which is interlocked with the rotor 19 of the lock unit 17 so as to be engaged with and disengaged from the locking hole 13 of the push button 11. Provided in the front-end portion of the leaf spring 22 is the bent portion 23 which holds the push button 11 in its depressed position by engaging with the engaging-hook portion 14 of the push button 11 when the push button 11 is depressed to swing on the pivot 10. The length of the latch element 20 is so determined as to have its front-end portion be free from the engaging-hook portion 14 of the push button having been held in the depressed position by the leaf spring 22, the latch element 20 being in its retracted position. Consequently, even when the latch element 20 is disengaged from the locking aperture 13 when the user rotates the rotor 19 in its unlocking direction by the use of the key inserted in the lock unit 17 to have the latch element 20 retracted slidably rearward, there is no fear that the user's fingers are hit by the leg portion 12 of the push button 11 or the front-end portion of the handle 8, because the handle 8 is held in its retracted position within the front concave portion 6 of the casing 2 by the front-end portion of the latch element 20 being engaged with the engaging-hook portion 14 of the push button 11, i.e., because the handle 8 is swingably projected from the casing 2 after the lock unit 17 is unlocked so that the user's fingers are already moved to the front surface of the lock unit 17.

As a result, in the present invention: it is possible to minimize a clearance between the lock unit 17 and the handle 8 having the push button 11; and, the leg portion 12 of the push button 11 may effectively serve as a finger-engaging portion of the push button 11. Therefore, it is possible to considerably reduce the length. of the handle 8 by an amount corresponding to the length of the push button 11, while keeping a sufficient effective length of the grip portion of the handle 8, which enables the entire length of the casing to be minimized.

Further, in the present invention: the longitudinal groove 60 axially extending in the outer surface of the locking shaft 9 opens rearward; the circumferential groove 61 is so provided as to be crossed with the front-end portion of the longitudinal groove 60 in the outer surface of the locking shaft 5; the drop-prevention projection 62 is provided in the inner surface of the cylindrical portion 3 of the casing 2, the projection 62 passing through the longitudinal groove 60 to engage with the circumferential groove 61; the drop-prevention projection 62 is so arranged as to be misaligned with the longitudinal groove 60 when the locking shaft 5 is rotated to travel between the locking and the unlocking position; and, the locking shaft 5 is prevented from moving forward by the drop-prevention projection 62 engaging with the circumferential groove 61.

Since the door locking handle assembly of the present invention has the above construction, it is possible to mount the catch plate 4 on either a left side or a right-side of the door 1 in an easy manner without requiring a cumbersome disassembling work of the locking shaft 5 and the handle 8. Further, in operation, it is possible for the user to side-swing the handle 8 smoothly regardless of a variation in thickness of the catch plate 4.

What is claimed is:

1. A door locking handle assembly of a pull-out and side-swinging lever-action type, comprising:

a casing (2) for fixedly mounting on a door (1);

a locking shaft (5) rotatably mounted in a cylindrical portion (3) of a base-end portion of said casing (2) in an insertion manner, said locking shaft (5) having its rear-end portion fixed to a catch plate (4);

a retractable handle (8) which folds into a front concave portion (6) of said casing (2), and has its base-end portion pivoted to a front-end portion of said locking shaft (5) through a first cross pivot (7);

a biasing spring (9) for swingably biasing said retractable handle (8) in its projecting direction on said first cross pivot (7), said biasing spring (9) being mounted between said locking shaft (5) and said handle (8);

a push button (11) which is connected with a front-end portion of said handle (8) through a second cross pivot (10) and is provided with a projecting leg portion (12) on a push button rear side, said leg portion (12) having its front-end portion formed into a locking hole (13) and an engaging-hook portion (14);

a position-keeping spring (15) disposed between said handle (8) and said push button (11) to align said push button (11) with said handle (8) along an extension line of said handle (8);

a lock unit (17) which is fixedly embedded in a lock-receiving portion (16) of a front-end portion of said casing (2), and comprises a rotor (19) which is rotated by a key (18) to move a latch element (20) forward and backward so that said latch element (20) engages with and disengages from said locking hole (13) respectively, said latch element being biased forward by a return spring (21) toward said leg portion (12);

a leaf spring (22) disposed in a position behind a rear surface of said latch element (20) and fixedly mounted in said position, said leaf spring (22) having a front-end bent portion (23) engaged with the engaging-hook portion (14) of said leg portion (12) when said push button (11) is depressed to swing on said second cross pivot (10) so that said push button (11) is held in the thus depressed position;

said latch element (20) having a length permitting a front-end portion of said latch element (20) to be free from said engaging-hook portion (14) of said push button (11) in said depressed position when said latch element (20) is held in its backwardly retracted position;

said locking shaft (5) being provided with a longitudinal groove (60) in its outer surface to permit said groove (60) to open to a rear surface side, said longitudinal groove (60) having a front-end portion crossed with a circumferential groove (61) in the outer surface of said locking shaft (5);

said cylindrical portion (3) of said casing (2) being provided with a drop-prevention projection (62) in its inner surface, said projection (62) passing through said longitudinal groove (60) to engage with said circumferential groove (61); and said drop-prevention projection (62) being so arranged as to be misaligned with said longitudinal groove (60) when said locking shaft (5) rotates to travel between a locking and an unlocking position.

2. The door locking handle assembly of claim 1, wherein said casing (2) is fixedly mounted on a door (1) and said catch plate (4) is engaged with and disengaged from a receiving portion (25) of a stationary frame element.

* * * * *